US007127750B2

(12) United States Patent
Lim

(10) Patent No.: US 7,127,750 B2
(45) Date of Patent: Oct. 31, 2006

(54) TOILET SYSTEM ATTACHED A HAND HELD SPRAYER

(76) Inventor: Howard Tak Su Lim, 12210 Rives Ave., Downey, CA (US) 90242

( * ) Notice: Subject to any disclaimer, the term of this patent is extended or adjusted under 35 U.S.C. 154(b) by 0 days.

(21) Appl. No.: 10/983,552

(22) Filed: Nov. 8, 2004

(65) Prior Publication Data

US 2005/0144713 A1 Jul. 7, 2005

Related U.S. Application Data

(63) Continuation-in-part of application No. 10/751,546, filed on Jan. 5, 2004, now Pat. No. 6,941,590.

(51) Int. Cl.
*A47K 3/22* (2006.01)

(52) U.S. Cl. ..... 4/420.4; 4/448; 4/420.5; 4/420.1

(58) Field of Classification Search ..... 4/443, 4/447, 448, 570, 615, 420.1, 420.2, 420.4, 4/420.5
See application file for complete search history.

(56) References Cited

U.S. PATENT DOCUMENTS

| | | | |
|---|---|---|---|
| 3,425,066 | A | 2/1969 | Berger |
| 3,670,966 | A | 6/1972 | Korda |
| 3,995,326 | A | 12/1976 | Umann |
| 4,000,742 | A | 1/1977 | DiGiacomo |
| 4,014,355 | A | 3/1977 | DiMatteo et al. |
| 4,069,519 | A | 1/1978 | Alexander |
| 4,094,018 | A | 6/1978 | Bemthin |
| 4,123,807 | A | 11/1978 | Oguma et al. |
| 4,127,904 | A | 12/1978 | Junker |
| 4,135,255 | A | 1/1979 | Menendez |
| 4,181,985 | A | 1/1980 | Rius |
| 4,195,369 | A | 4/1980 | Lesick |
| 4,197,594 | A | 4/1980 | Butterfield |
| 4,205,402 | A | 6/1980 | Miller |
| 4,206,520 | A | 6/1980 | Fulford |
| 4,207,628 | A | 6/1980 | Ibel |
| 4,208,746 | A | 6/1980 | Minamoto et al. |
| 4,233,696 | A | 11/1980 | Ibel |
| 4,237,560 | A | 12/1980 | Riegelman et al. |
| 4,242,764 | A | 1/1981 | Fukuda |
| 4,259,754 | A | 4/1981 | Bader et al. |
| 4,304,016 | A | 12/1981 | Oguma et al. |
| 4,340,980 | A | 7/1982 | Fushimi et al. |
| 4,366,584 | A | 1/1983 | Mchuma |
| 4,371,993 | A | 2/1983 | Patrick |
| 4,383,339 | A | 5/1983 | Miller |
| 4,386,928 | A | 6/1983 | Hart |
| 4,406,025 | A | 9/1983 | Huck et al. |
| 4,422,189 | A | 12/1983 | Couvrette |
| 4,441,219 | A | 4/1984 | Epstein |

(Continued)

*Primary Examiner*—Justine R. Yu
*Assistant Examiner*—Huyen Le

(57) ABSTRACT

The invention relates to a toilet system affording hygienic environment by attachment of a hand held sprayer and additional features on the existing toilet system. The hand held sprayer that delivers water spray comprises a reinforced flexible hose, a filter to eliminate the pollutants in the water, a valve to regulate the flow, a mixing valve that supplies tempered water, a T-adapter assembly to tap water from an existing plumbing fixture, a holder assembly for placement of the sprayer with various positions using an adjustable bracket, and a hose hanger for arrangement of the hose. The new features include a toilet seat having a water splash guard on underbody of the seat and a filler element around the bracket to offset the inclined toilet lid.

10 Claims, 6 Drawing Sheets

U.S. PATENT DOCUMENTS 4,450,596 A 5/1984 Cohen
4,451,943 A 6/1984 Nibler
4,510,630 A 4/1985 Osgood
4,551,867 A 11/1985 Gurevich et al.
4,553,274 A 11/1985 Yui
4,581,779 A 4/1986 Matsui et al.
4,596,058 A 6/1986 Nourbakhsh
4,636,474 A 1/1987 Ogura et al.
4,638,514 A 1/1987 Landsberger
4,642,820 A 2/1987 Boring, Jr.
4,807,311 A 2/1989 Ingels
4,924,534 A 5/1990 Basile
4,926,509 A 5/1990 Bass
4,967,423 A 11/1990 Aoyama
5,295,274 A 3/1994 Daniels et al.
5,419,363 A 5/1995 Robinson
5,652,971 A 8/1997 Wokas
5,720,055 A * 2/1998 Krist ..... 4/420.4
5,765,238 A 6/1998 Furukawa et al.
5,809,585 A 9/1998 Farshad
5,884,345 A 3/1999 Sugiyama et al.
5,911,516 A 6/1999 Chang
5,933,881 A 8/1999 Smith
5,937,451 A 8/1999 Mihara
5,953,766 A 9/1999 Szoke
5,960,485 A 10/1999 Mihara
5,987,659 A * 11/1999 Cannizzaro ..... 4/420.2
5,991,937 A 11/1999 Safara
6,073,275 A 6/2000 Klopocinski
6,105,179 A 8/2000 Burns
6,178,568 B1 1/2001 Boulieris
6,192,527 B1 2/2001 Paul
6,321,396 B1 11/2001 Vallejo
6,397,406 B1 6/2002 Moshkovich
6,408,451 B1 6/2002 Carn et al.
6,473,913 B1 11/2002 Bell, Sr.
6,487,732 B1 12/2002 Smith
6,526,602 B1 3/2003 Jeon
6,618,865 B1 * 9/2003 Kim ..... 4/420.4
6,643,856 B1 11/2003 Valverde
6,665,888 B1 12/2003 Kwak

* cited by examiner

TOILET SYSTEM ATTACHED A HAND HELD SPRAYER

RELATED APPLICATIONS

This application is continuation-in-part (CIP) of prior U.S. patent application Ser. No. 10/751,546 applied on Jan. 5, 2004 now U.S. Pat. No. 6,941,590, which is fully incorporated herein.

BACKGROUND OF THE INVENTION

1. Field of Invention

This invention relates to a toilet system attached a hand held water spraying apparatus, engaging in delivering instant water supply for personal and environmental hygiene.

2. Description of Related Art

The invention in earlier application has been improved by adding new features, which include multiple layered reinforced flexible hose to bear the continuous high pressures, a filter for separating solid particles and impurities from water, a mixing valve that provides tempered water for the use in the cold temperature, a T-adapter together with matching couplings to tap water from an existing plumbing fixtures, a modified hose hanger mounted on the existing toilet seat fasteners, a holder assembly with new features for placement of the sprayer with various positions, a filler element around the bracket on the top edge of water tank to keep the toilet lid in the flat position, and a toilet seat having a water splash guard under the seat to protect water escape through the gap between the toilet seat and the bowl.

The flexible hose in the current market has limited options available for the use of this invention. One choice is a shower hose, which is used to convey the high pressurized water for the bathtub or sink. The shower hose generally has two layers, in which one layer of the inner flexible hose is wrapped with the other layer of the flexible metal or plastic tube. The shower hose has a cosmetic appearance, but it is not durable enough to be used for an extended amount of time under the continuous high water pressure. Besides, the inner flexible tube has a large diameter to carry much of water for the use in the bath or sink. The hose with the larger diameter holds more pressures than the one with the smaller, causing more inflexibility of the hose under the internal built-up pressures.

Another choice is one of the plumbing hoses, which are designed to supply water under the continuous high pressure. The plumbing hoses have large inner diameter to deliver much of water and general categories of the PVC-reinforced hoses and stainless steel braided hoses. The plumbing hoses are good to supply water in a static environment, but they are not enough flexible for dynamic movement and lack of the ornamental appearances. The present invention includes a reinforced hose having the decorative appearances by combining the good features of the shower hose and the plumbing hose. This invention requires small amount of water for the purpose of the use, adopting a flexible inner hose with small diameter. The inner hose with small diameter absorbs less of the pressure from the source to contribute more flexibility, and affords room to place the second layer of braided metal mesh for reinforcement. The exterior ornamental layer including the flexible stainless steel adds more durability as well as the cosmetic appearances.

The mixing valve is provided to supply tempered water for the use in the cold environment or for better personal care. The previous application uses only cold water tapped into the existing water supply line, which may not be allowed for the use if the water temperature is extremely cold. If the hot water source is available, the present invention utilizes it to supply warm water by employing the mixing valve connected to both of the hot and cold water. Since the hot water source is located in the various areas around the toilet, the present invention employs an angle stop valve behind the toilet as for the illustration.

The T-adapter is applied for this invention, which includes but not limited two outlet male threads and one inlet female rotatable nut. The female rotatable nut is affording convenience for connection in a confined area, because it can be connected without rotation of the large body and locked with the body placed in various directions. The T-adapter may require matching couplings for the inlet and for the outlet to adapt to the various sizes of the existing plumbing fixtures. The various sized T-adapter may eliminate the matching couplings, but it brings more complexity and costs more for productions.

The modified hose hanger with new features is introduced for this invention to reinforce and facilitate arrangement of the hose and installation to the existing seat fasteners. The single body of hose hanger has prop lines on the body to fortify its structure and protruding lines to prevent the hose being mobile in the openings. The protruding lines make the hose placement easier at any part of the free length, because they lock in the hose to prevent slippage. The opening for permanent placement of the hose locks a part of the hose so that the hose hanger is not easily pivoted side to side. The indentation surface is provided on the mounting area for more friction to prevent spinning around.

A holder of the holder assembly has an additional feature for placement of the sprayer, in which the sprayer can be placed in various ways including a high placement and a low placement. The high placement that implements the controller body of the sprayer requires an angled base in the opening of the holder. However, the low placement that takes on the extension bar of the sprayer requires a straight lined base in the opening of the holder. Therefore, the low placement has need of the offset element so that the sprayer is placed in level in the holder.

The adjustable bracket of the holder assembly is introduced for mounting on various types of the water tank of toilets. The outlook of the toilet water tank takes varied shapes including rectangles and trapezoids. The adjustable bracket has the features to be adjusted to the varied environment. It also has the feature to be mounted on any available surfaces if the toilet water tank does not have room for the bracket to be placed on. The adjustable bracket accommodates the filler element such as a foam strip around the top edge for the leveled placement of the toilet lid.

The toilet seat having a water splash guard underbody is presented to protect water escape through the opening between the toilet seat and the bowl. The splash guard around the seat opening is located between the seat and the bowl to add more protection from water splash whenever the sprayer is used inside bowl. The shape and width of the water splash guard is determined from the features of the seat and the bowl. However, the width of the water splash guard is preferably larger than the gap between the seat and the bowl for better protection. The water splash guard can be placed with full or partial enclosure according to the seat opening type.

SUMMARY OF THE INVENTION

The present invention provides a toilet system attached a hand held sprayer, wherein the new features are added to achieve more functions than the prior application. The hand held sprayer, namely a "sprayer", requires a special long flexible hose including multiple layered structures to hold the continuous high pressurized water, to be flexible to maneuver under the internal high pressures built up, to be thin as much as possible for easy handling, and to be aesthetic as possible. Because the existing hose does not satisfy these specifications, the new hose is presented to meet the purposes. The inner tube with smaller diameter supports the flexibility under the high pressures and maintains the thinness for easy handling. The smaller tube also offers the room for placement of the next layer such as the flexible metal braided mesh to hold the high pressures for continuous use. The flexible braided metal layer is again wrapped with the flexible ornamental material to add more durability and aesthetic beauties.

The flexible hose is connected to the valve to obtain water supply. The valve is for adjusting the water flow to the system and turning off in the emergency. The valve is then connected to the mixing valve for supplying tempered water. Two inlets of the mixing valve are connected to the hot water source through a water supply line and the cold water source through a T-adapter tapped into the existing water supply line leading to the toilet water tank. The mixing valve has a control knob to adjust mixture of the hot and the cold water for the individual use. The T-adapter may require two matching couplings to adapt to the various sizes of the plumbing fixtures.

The modified hose hanger is supplied for arrangement of the long flexible hose. The one opening under the body is for permanent placement of a part of the flexible hose connected to the valve. The hose hanger is reinforced with the protruding prop lines aligned on the body. The prop lines lock the hose to prevent the hose hanger being pivoted side to side. The upward opening on the body is for temporary placement of the loose part of the hose. The protruding lines in the opening support stable placement of the hose without slippage over the hanger. The indented surface on the mounting area adds more resistance for the hose hanger to be rotated.

The new sprayer holder assembly has more adaptability to the various environments for placement using a spacer. The attachable spacer at the base of the holder enables the sprayer to be placed in the low placement with a stable state. The holder is secured to the bracket with the fasteners to be mounted over the rim of the water tank. The filler element placed around the bracket on the lid or on the top of the water tank is introduced for levelness of the lid. The bracket is fully adjustable within a limit in accordance with the varied angled mounting surfaces. Finally, the toilet seat has a water splash guard under the seat body to protect from water escape through the gap between the seat and toilet bowl. The water splash guard is fully or partially enclosed around the opening of the seat according to the seat configurations and the purposes of the use.

DESCRIPTION OF THE PREFERRED EMBODIMENTS

Figure 1:
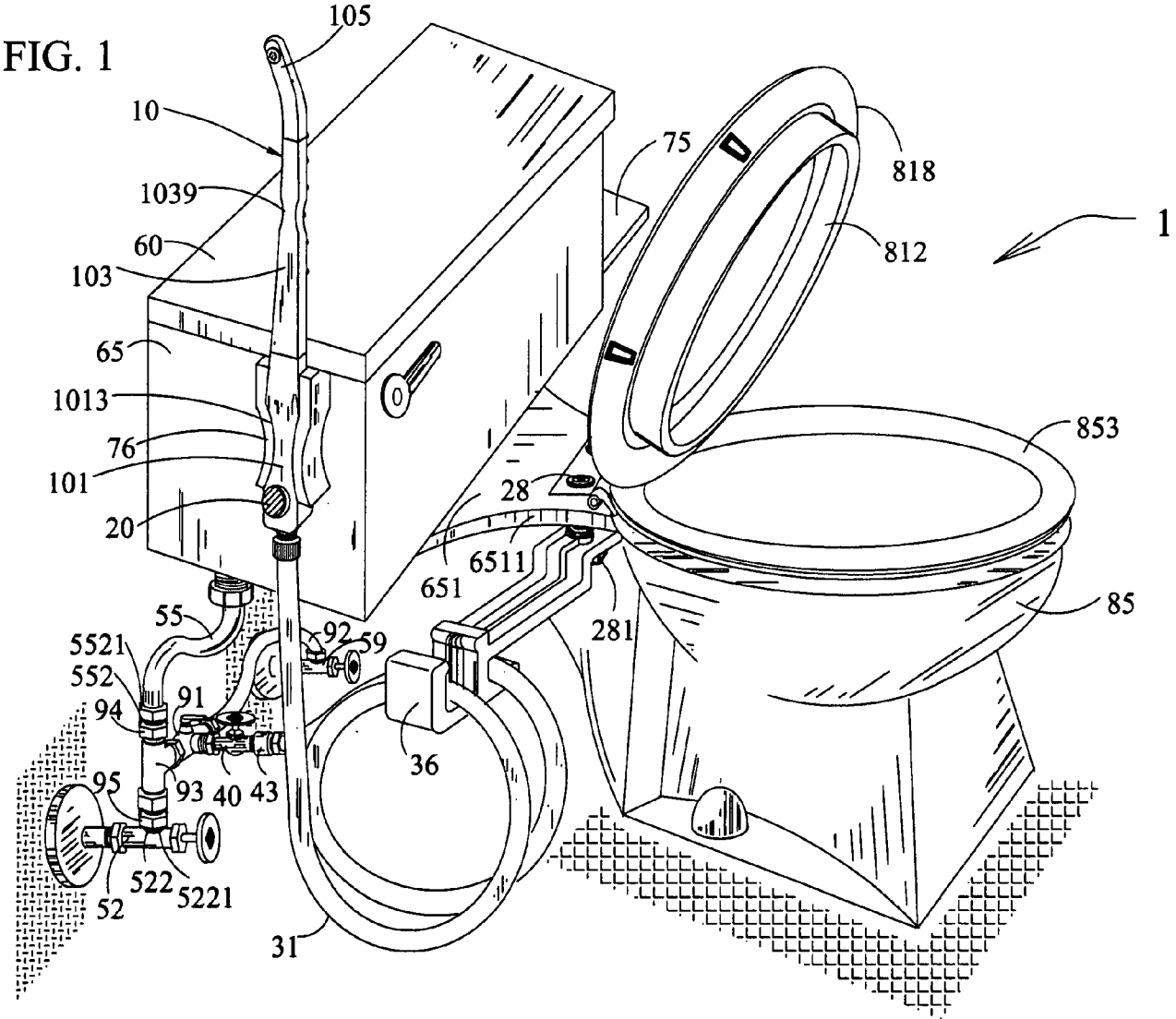
FIG. 1 is a perspective view showing a toilet system attached a hand held sprayer connected to the existing hot and cold water supply lines.

Reference is now made in detail to the present invention, examples of which are illustrated in the accompanying drawings wherein reference numerals having the same first two digits indicate related elements, such as 36 and 365. The numerals having the same first three digits indicate same components with different elements, such as 365 and 3651. General structures of the present invention will be described following by details and the function of components. Referring to FIG. 1, a perspective view of the present invention, a toilet system attached a hand held sprayer, is shown and indicated the number 1. The system is generally composed of a hand held sprayer 10, namely "sprayer"; a flexible hose 31; a filter 43; a valve 40; a mixing valve 91; a hot water supply line 92 from a hot water source 59; a T-adapter 93 with a matching coupling 94 for the water supply line 55 and a matching coupling 95 for the existing angle stop valve 52; a hose hanger 36 mounted on the toilet seat fastener 28 using a nut 281; a holder assembly 76 for the sprayer 70; a holder assembly for the lavatory items 75; a water splash guard 812 for the toilet seat 818. There are filler elements included on the top edge of the water tank 65 and on the lid 60, but they are hidden. More details are in the following with full descriptions.

Figure 3:
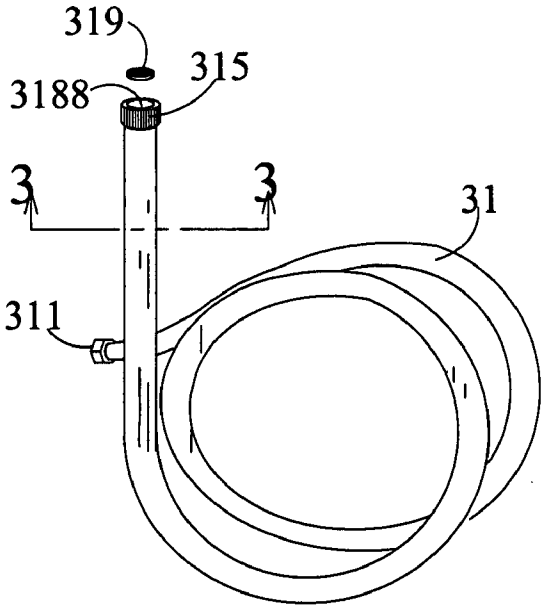
FIG. 3 is a perspective view of the new flexible hose for the hand held sprayer.

The sprayer 10 in FIG. 1, comprising a controller 101 with a pushbutton 20 and an extension bar 103 with a spray tip 105, is connected to a flexible hose 31 in FIG. 1 with means to secure including but not limited a coupling 315 of FIG. 3. The flexible hose 31 utilizes a filter insert 319 in FIG. 3 to eliminate impurities in the water. The sprayer 10 utilizes small amount of water, requiring the flexible hose 31 having an inner hose with small diameter. It does not demand as much water as the conventional hose delivers, wherein the conventional hose has the inner hose with large diameter to supply much of water. The flexible hose 31 for the use of the sprayer 10 requires multiple conditions of (1) the length being long enough to support for personal and environmental hygiene, (2) the durability being strong enough to hold continuous high pressurized water for a long period, (3) the flexibility being comfortable to move for the use under the high internal pressures built up, (4) the thickness being as small as possible to maneuver for the application, and (5) the appearance being aesthetic for the display in the bathroom. The conditions of (1) through (4) are related to the functional elements and the condition of (5) is related to the aesthetic element for the hose.

Figure 3C:
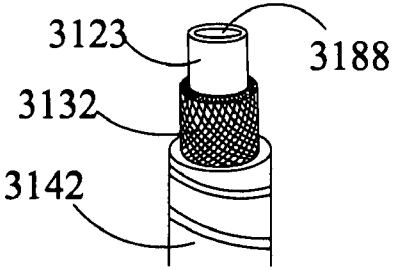
FIG. 3C is a structural view of the currently invented flexible hose taken on the line 3—3 of FIG. 3 having a small inner hose braided with a metal mesh and then enclosed with a flexible ornamental metal tube.
Figure 3B:
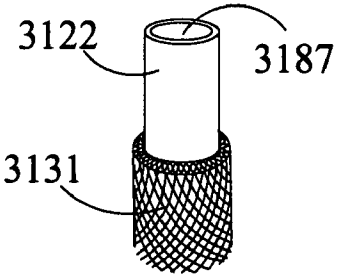
FIG. 3B is a structural view of the conventional plumbing hose or water supply line having a large inner hose braided with a metal mesh to hold the continuous high pressures.
Figure 3A:
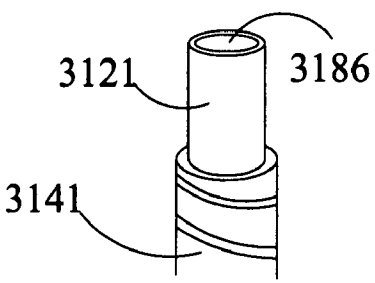
FIG. 3A is a structural view of the conventional shower hose having a large inner hose enclosed with a flexible ornamental metal tube.

The conventional shower hose having two layers as in FIG. 3A includes an inner hose 312 having a large diameter 3186 enclosed by an ornamental element 3141 made of metal or plastic. The flexible inner hose 3121 having a large diameter 3186 absorbs high pressures from the water supply source, if not released, causing severe inflexibility of the hose. The outer ornamental element 3141 is usually not strong enough to hold the continuous high pressures for a long period. The plumbing hose as in FIG. 3B used for the water supply line includes a reinforced inner hose 3122 enclosed with the outer layer of the braided metal mesh 3131. The plumbing hose having the large inner hose and heavy braided metal mesh 3131 is sturdy to hold the high pressure but not much flexible to use for the hand held sprayer. Its outer appearance is not decorative due to the lack of ornamental element. The present invention as in FIG. 3C includes a flexible inner hose 3123 having a small diameter 3188, wherein the small inner hose affords room for the next layer while keeping the same or smaller thickness. The inner hose 3123 is enclosed with the next layer of the braided metal mesh 3132 and then with the outer layer of the ornamental element 3142 including but not limited flexible metal tube to fulfill the conditions of said functional and aesthetic elements.

The hose 31 in FIG. 3 is further connected to the outlet 435 of the filter 43 with means to secure for further eliminating the pollutants in the water. The means to secure include but not limited the rotatable female threaded nut of the hose 311 and the male thread 4351 of the filter 43 for connection with seals. The inlet 431 of the filter 43 is connected to the outlet 405 of the valve 40 with means to secure to get the flow of water regulated. The means to secure include but not limited the female inlet thread 4311 of the filter 43 and the male thread 4051 of the valve 40 for securing with seals. The valve 40 is used for regulating and turning off the water flow with the handle 402 for use of the sprayer. The inlet 401 of the valve 40 is connected to the outlet 915 of the mixing valve 91 with the means to secure with seal to receive the tempered water. The means to secure include but not limited the rotatable female threaded nut 4011 of the valve 40 and the male thread 9151 of the mixing valve 91 for connection with seals. The rotatable female threaded nut is useful for connection, because it allows the valve 40 secured to the mixing valve 91 while maintaining the handle 402 in any position. All the means to secure have seals including but not limited washers, gaskets, or tapes between the female threaded openings and the male thread for sealing in the connection.

The mixing valve 91 connected to the valve 40 is introduced for mixing the hot water and the cold water carried from the two inlets. One inlet 913 of the mixing valve 91 is connected to the hot water source 59 in FIG. 1 through the water supply line 92 with means to secure. The means to secure include but not limited the rotatable female threaded nut 923 of the water supply line 92 and the male thread 913 of the mixing valve 91 for connection with seals. The other inlet 911 of the mixing valve 91 is connected to the outlet 935 of the T-adapter 93 with the means to secure to receive the cold water. The means to secure include but not limited the rotatable female threaded nut 9111 of the mixing valve 91 and the male thread 9351 of the T-adapter 93 for connection with seal. The handle 916 of the mixing valve 91 is used for regulating the water temperature for various usages. The hot water source 59 is located at the various places in the bathroom, which may require special skills for the proper work.

The T-adapter 93 is connected between the existing angle stop valve 52 in FIG. 1 and the water supply line 55 leading to the toilet water tank. The T-adapter having the sizes of ½ IPS is generally used for receiving the water supply from the angle stop valve 52, delivering to the water supply line 55 and to the mixing valve 91. The inlet 931 of the T-adapter 93 is connected to the angle stop valve 52 with means to secure. The means to secure include but not limited the rotatable female threaded nut 9311 of the T-adapter 93 and the male thread of the existing angle stop valve 52 for connection with seals. The outlet 933 is connected to the inlet 552 of the water supply line 55 in FIG. 1 with means to secure. The means to secure include but not limited the rotatable female threaded nut 5521 of the water supply line 55 in FIG. 1 and the male thread 9331 of the T-adapter 93 for connection with seals.

Figure 2:
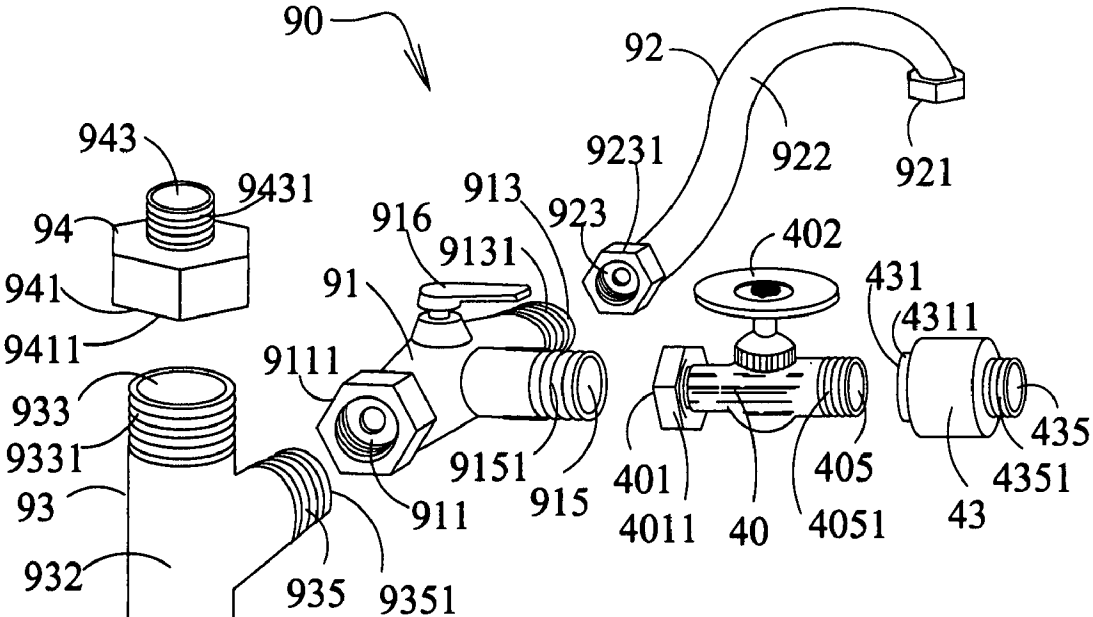
FIG. 2 is an exploded perspective view of the plumbing fixtures that include a filter, a valve, a mixing valve, a hot water supply line, a T-adapter, and matching couplings to supply tempered water to the hand held sprayer.

The matching coupling 95 in FIG. 2 is employed for the T-adapter 93 to connect to the existing angle stop valve 52 having unlike size with means to secure. The means to secure include but not limited the rotatable female threaded nut 9311 of the T-adapter 93 and the male thread 9531 of the matching coupling 95 for connection with seals. The inlet 951 of the matching coupling 95 is connected to the outlet 522 of angle stop valve 52 with means to secure. The means to secure include but not limited the female thread 9511 of the matching coupling 95 and the male thread 5221 of the angle stop valve 52 for connection with seals. The matching coupling 94 in FIG. 2 is used for the T-adapter 93 to connect to the existing water supply line 55 having unlike size with means to secure. The means to secure include but not limited the female thread 9411 of the matching coupling 94 and the male thread 9331 of the T-adapter 93 for connection with seals. The outlet 943 of the matching coupling 94 in FIG. 2 is connect to the inlet 552 of water supply line 55 in FIG. 1 with means to secure. The means to secure include but not limited the rotatable female threaded nut 5521 of the water supply line 55 in FIG. 1 and the male thread 9431 of the matching coupling 94 for connection with seals.

Figure 4:
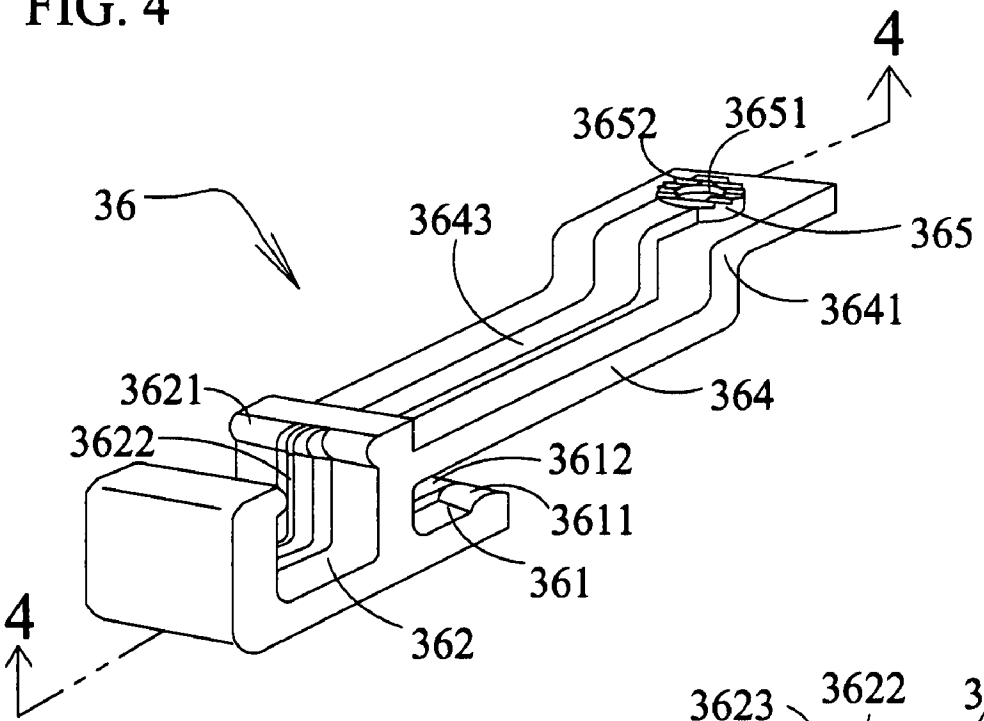
FIG. 4 is a perspective view of the hose hanger.
Figure 4A:
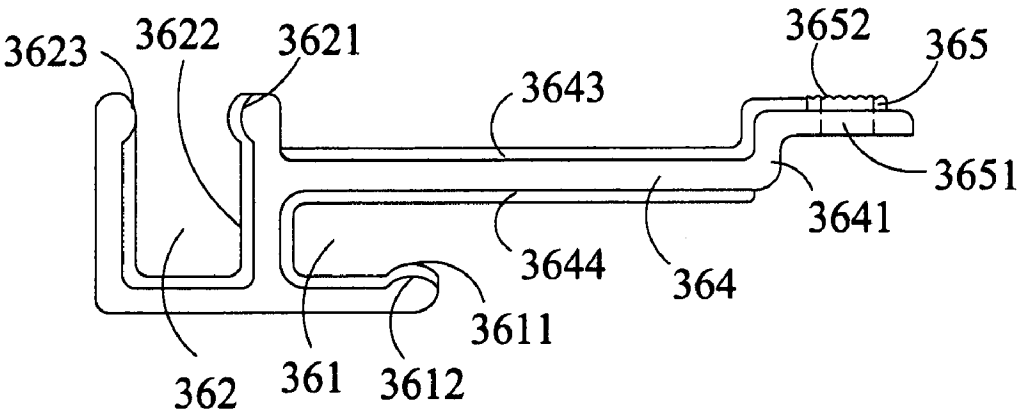
FIG. 4A is a section view of the hose hanger taken on the line 4—4 of FIG. 4.

The hose hanger 36 in FIG. 4 includes the extended lengthy flat bar 364 having multiple openings for placement of the flexible hose 31 in FIG. 3. The opening 361 in FIG. 4 located but not limited under the bar in the direction having but not limited lateral path is for permanent placement of the hose at one near end connected to the filter 43 as shown in FIG. 1. The opening 361 in FIG. 4A of the hose hanger 36 has a raised element 3611 at the entrance to prevent the hose being displaced and a protruding line 3612 to lock in the hose. The hose hanger 36 stays stable at a certain position without much pivotal movement because the protruding line 361 of the hose hanger 36 locks a part of the hose 31 which is connected to the immobilized filter. The upward opening 362 in FIG. 4A of the hose hanger 36 is for temporary placement of any free part of the flexible hose 31 as shown in FIG. 1. The raised elements 3621, 3623 in FIG. 4A at the entrance of the opening 362 assist to prevent the hose 31 being displaced and the protruding line 3622 supports to lock in the hose 31 at any position. The prop lines 3643, 3644 in FIG. 4A on the bar 364 are located to reinforce the bar strength. The mound 365 is provided to reinforce the area for mounting and the small hole 3651 on the mound 365 in FIG. 4A is located for securing on to the fastener 28 in FIG. 1 using the nut 282. The indented surface 3652 on the mound 365 around the hole 3651 is added for the hose hanger 36 to prevent its pivotal movement. Because the toilet body 651 generally has the angled edge 6511 near the mounting location, the hose hanger 36 is supplied with angled body 3641 for placement over the edge 6511 as shown in FIG. 1.

Figure 5:
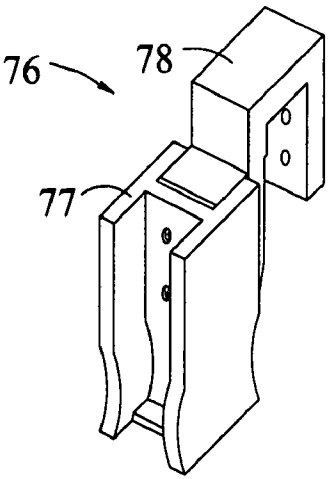
FIG. 5 is a perspective view of the sprayer holder assembly having an adjustable bracket attached on the body.

The holder assembly 76 in FIG. 5 for placement of the lengthy sprayer 10 in FIG. 1 comprises the holder body 77 and the bracket 78. The holder body 77 in FIG. 5A has a body 771 that contains the opening 773 for placement of the bracket 78 and the opening 772 for placement of the sprayer 10. The holder body 77 includes the concave element 774 for securing the lengthy sprayer 10 in FIG. 1 in the place using the same concave element of the sprayer body. The concave element 1013 in FIG. 1 on the controller 101 of the sprayer 10 is for the high placement and the one 1039 on the extension bar 103 is for the lower placement of the sprayer 10. The lower placement of the sprayer 10 requires the spacer 776 in FIG. 5A on the base of the opening 772 to offset the difference arisen from the dissimilar thicknesses between the controller and the extension bar in order that the sprayer is placed in the evenly manner. The holes 775 on the holder body 771 are for the fasteners to be secured to the bracket 78 or to any available mounting places.

Figure 5A:
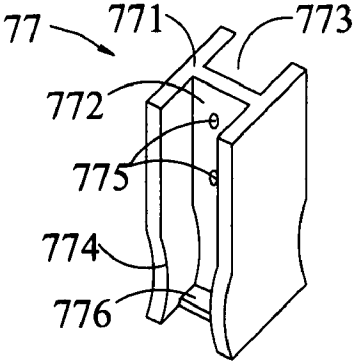
FIG. 5A is a perspective view of the holder body isolated from FIG. 5.
Figure 5B:
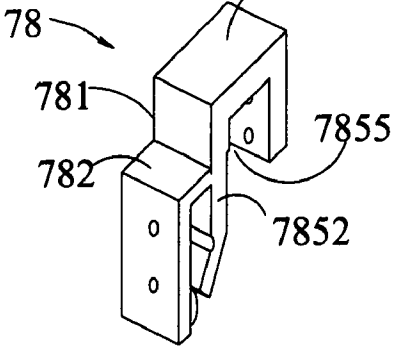
FIG. 5B is a perspective view of the adjustable bracket isolated from FIG. 5.
Figure 6:
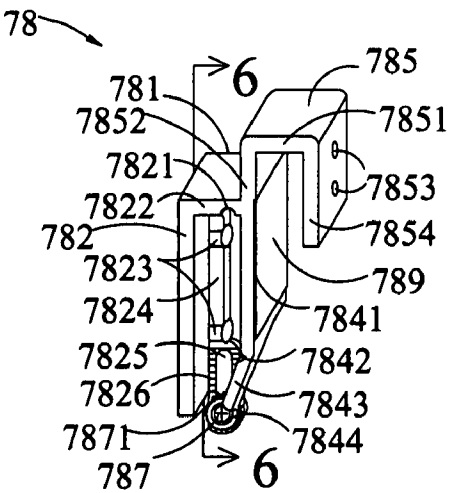
FIG. 6 is a perspective view of the adjustable bracket.

The adjustable bracket 78 in FIG. 5B for the holder 77 in FIG. 5A includes the body 781 having a reversed U-type clamp 785 with an opening 7855 for mounting over the top edge of the water tank 65. The reversed U-type clamp 785 in FIG. 6 have three body elements: first body element 7854 being secured inside of the toilet water tank preferably but not limited above the water line 651 as shown in FIG. 8A, second body element 7852 being secured outside of the water tank, and third body element 7851 connecting first and second body elements for being placed on the top edge of the water tank. First body element 7854 in FIG. 6 includes small openings 7853 for means to secure 7858 in FIG. 8A. Second body element 7851 in FIG. 6 has the surface element 7841 for placing securing means including but not limited the foam tape 789 having adhesive on both sides for additional bondage. Second body element 7852 in FIG. 6 is extended for connection with the spacer element 7843 through the cutout element 7842, wherein the spacer element 7843 has means for securing including but not limited the loop hole 7844 at the end using means to secure 787 including fasteners with the lock washer 7871. The cutout element 7842 is located to facilitate pivotal movement of the spacer element 7843 at the end of second body element 7852.

Figure 6A:
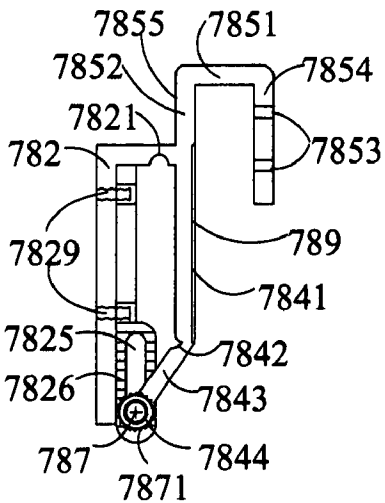
FIG. 6A is a section view taken on the line 6—6 of FIG. 6 with the body in an upright position.
Figure 6B:
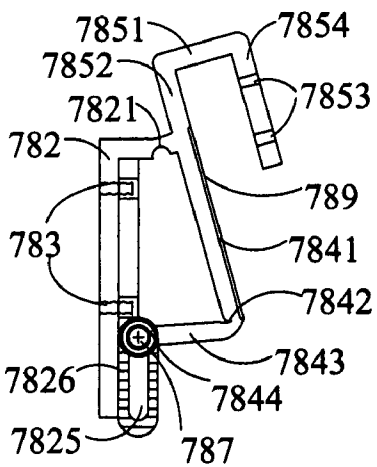
FIG. 6B is a section view taken on the line 6—6 of FIG. 6 with the body in an angled position.

The adjustable bracket 78 in FIG. 5B also includes the body 781 having an adjustable frame 782 that formulates the various angles for the reversed U-type clamp 785. The adjustable frame 782 in FIG. 6 is connected to second element 784 of the reversed U-type clamp 785 through the bridge element 7822. The bridge element 7822 having the cutout 7821 is located below third element 7851 of reversed U-type clamp 785 to give room 7855 for the toilet lid 60 in FIG. 8A. The cutout 7821 in FIG. 6 on the bridge element 7822 is located for the adjustable frame 782 to be easily pivoted. The adjustable frame 782 includes the prop element 7824 to reinforce the body structure, wherein the prop element 7824 contains the mound elements 7823 for the fasteners 778 in FIG. 8 to be secured. The prop element 7824 in FIG. 6 also contains the lengthy loop hole 7825 having the indentations 7826 around, wherein the indentations are located for more friction to lock the spacer element 7843 over the loop hole 7825. The spacer element 7843 in FIG. 6 is secured anywhere along the lengthy loop hole 7825 with means to secure including but not limited screw and the lock washer 786, making the reversed U-type clamp 785 be angled with certain degrees as shown in FIG. 6A and FIG. 6B.

Figure 9:
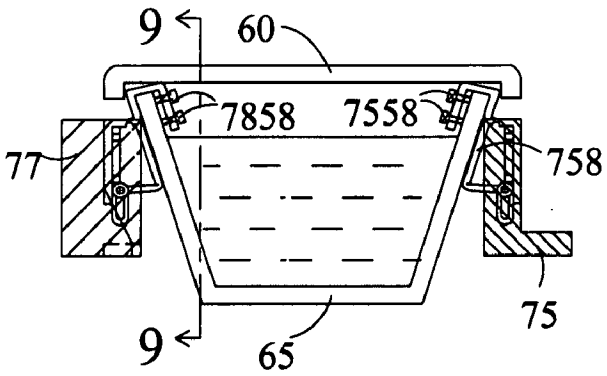
FIG. 9 is a side view of the holder assembly for the sprayer and for the lavatory items mounted over the side top edge of the water tank having two angled side walls with its lid covered.
Figure 9A:
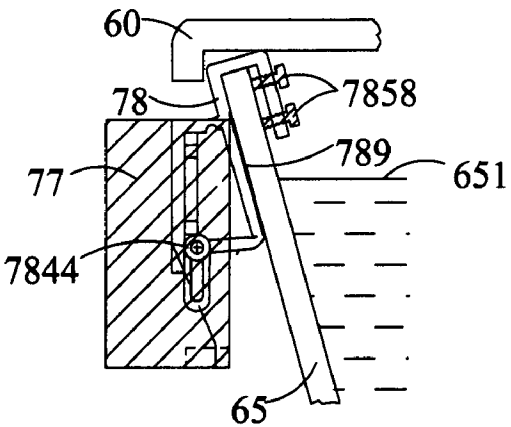
FIG. 9A is a side view of the holder assembly for the sprayer taken on the line 9—9 in FIG. 9.
Figure 8:
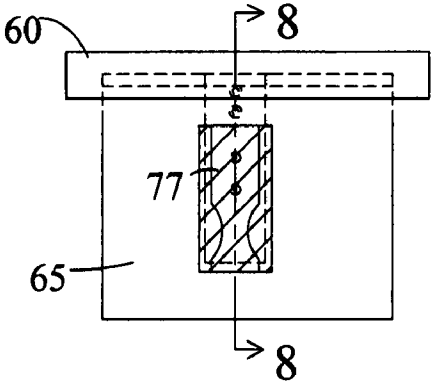
FIG. 8 is a front view of the holder assembly for the sprayer mounted over the side top edge of water tank with its lid covered.
Figure 8A:
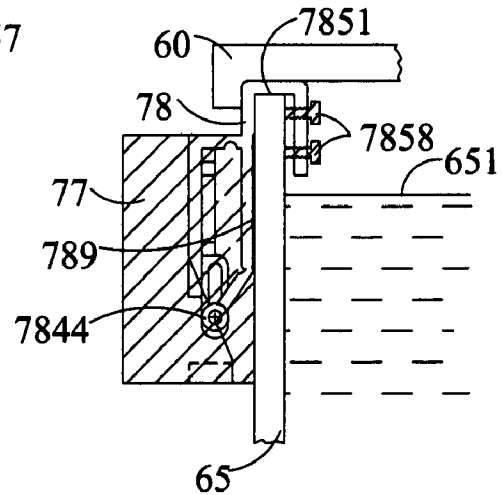
FIG. 8A is a side view of the holder assembly for the sprayer taken on the line 8—8 in FIG. 8.
Figure 7:
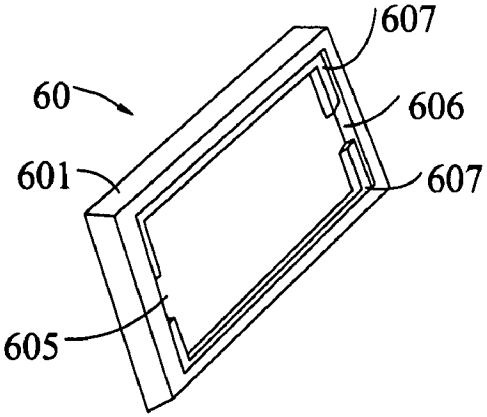
FIG. 7 is a perspective view of the toilet water tank lid with foam strips attached as a filler element except the places for the bracket.
Figure 7A:
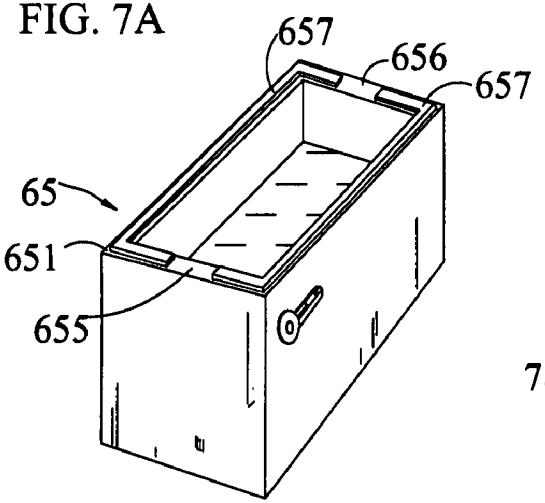
FIG. 7A is a perspective view of the toilet water tank with foam strips attached on the top edge as a filler element except the places for the bracket.

The adjustable bracket 78 assembled with the holder body 77 is placed over the top edge of the toilet water tank having straight wall as in FIG. 8 or angled wall as in FIG. 9. The adjustable bracket 758 FIG. 9 is applied to placement of lavatory items with the holder body 75 attached and secured to the reversed U-type clamp. The most part of the bracket 78 is hidden in the holder body 77 except the reversed U-type clamp 785, wherein the clamp 785 is secured to the interior wall of water tank 65 with the fasteners 7858. Third element 7851 in FIG. 8A of the reversed U-type clamp 785 has some material thickness, leaving the gap between the water tank 65 and its lid 60 surrounding the area. The filler element 607 including but not limited foam tape 789 having adhesive on one side is employed to offset the gap. The filler element 607 in FIG. 7 is located on the body 601 of the water tank lid 60 to be leveled except the areas 605, 606 for mounting brackets. The filler element 657 is alternatively located on the body 651 in FIG. 7A of the water tank 65 to level the lid 60 except the places 655, 656 for mounting brackets.

Figure 10A:
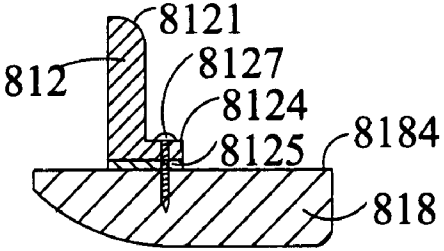
FIG. 10A is a section view taken on the line 10—10 of FIG. 10.
Figure 11:
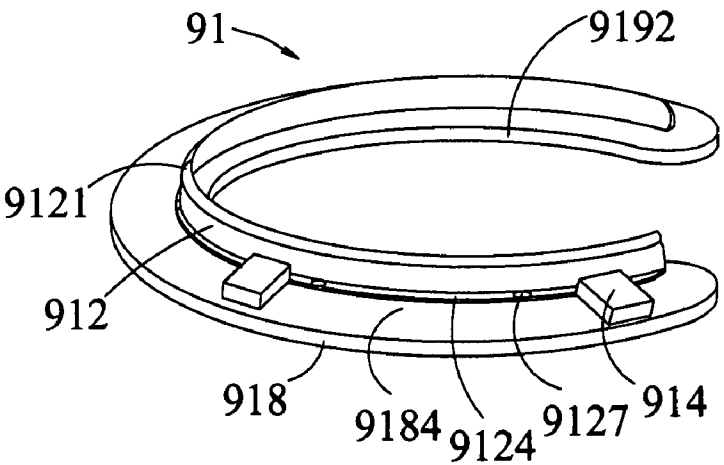
FIG. 11 is a perspective view of the open-ended toilet seat with the upside down having the water splash guard attached on underbody.
Figure 10:
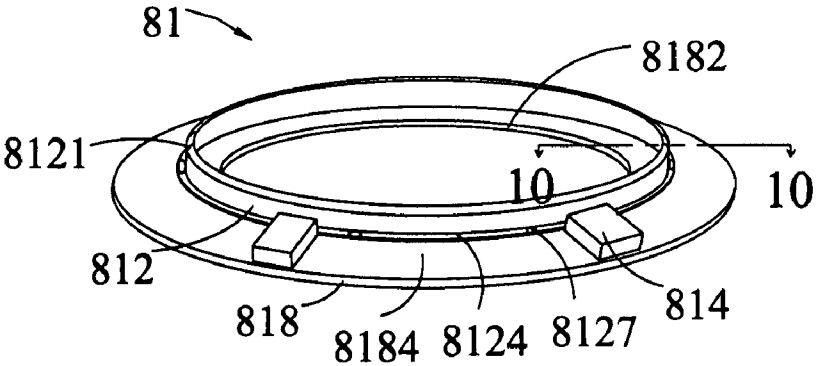
FIG. 10 is a perspective view of the close-ended toilet seat with the upside down having the water splash guard attached on underbody.
Figure 10B:
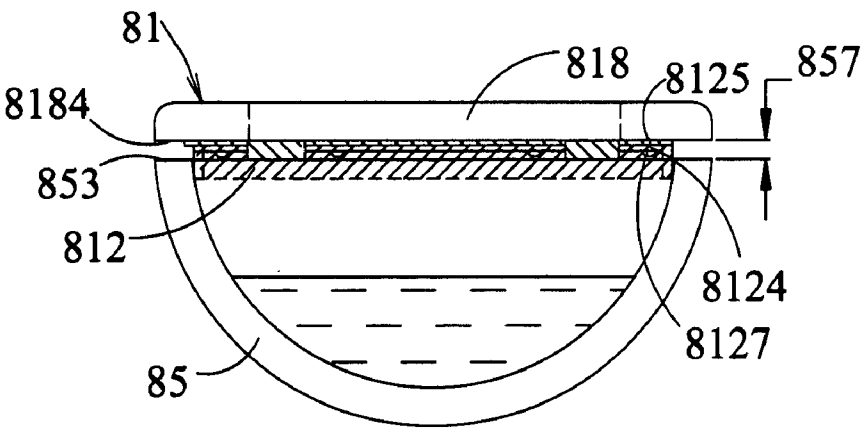
FIG. 10B is a cross-sectional side view of the toilet bowl with the toilet seat in FIG. 10 closed.

The water splash guard 812 in FIG. 10 is placed for the use of the sprayer inside of the bowl. It is located underbody 8184 of the toilet seat 81 around the opening 8182 to protect water escape through the gap between the toilet bowl 85 and the seat 81 in FIG. 11. The seat 81 in FIG. 10 generally contains multiple bumpers 814 on the underbody 8184 around the opening 8182 in the middle of the seat body 818 in FIG. 10. The bumpers around the opening 8182 create the gap 857 in FIG. 10B when the seat 81 is placed on the top edge 853 of the toilet bowl 85 in FIG. 10B. The water splash guard 812 in FIG. 10 is mounted for covering the gap 857 through the means to secure including but not limited the fasteners 8127 on the base 8124 of the water splash guard 812 with sealer 8125 as in FIG. 10A. The closed-ended water splash guard is fully located around the opening 8182 as in the FIG. 10 to protect the full surrounding gap. The width of the splash guard 812 is preferably greater than the thickness of the bumper 814, and the edge 8121 is to be placed inside the bowl as close as possible, so that the water escape through the gap 857 can be minimized. The edge 8121 having round or beveled rim facilitates the placement of the water splash guard into the toilet bowl 85. The open-end water splash guard is partially located around the opening 9192 as in the FIG. 11 for the open-ended seat 91. The water splash guard 912 in FIG. 11 for the open-ended seat 91 is mounted on the underbody 9184 of the seat 918 using means to secure 9127 on the base 9124. The edge 9121 of the water splash guard is preferably placed into the bowl as close to the inner top edge of the bowl to minimize water escape.

What I claimed as my invention is:

1. Toilet system attached a hand held sprayer comprises:

a hand held sprayer including a body having a controller with a shut-off valve and an extended body with a sprayer tip, said body including concave contours;

a holder including a body having an opening for said sprayer and an opening for a bracket, concave contours on said opening for said sprayer corresponding to the contour of the body of said sprayer for securing the sprayer to the sprayer holder, an offset element located in said opening for said sprayer to be in lower placement, said body including holes for fasteners to secure the sprayer holder to said bracket;

a holder including a body having an opening for placement of a holder assembly for the lavatory items an opening for a bracket, and holes for fasteners to said bracket;

a bracket for placement of said holder with means to secure the bracket to a toilet tank;

a holder assembly having said sprayer holder and said bracket combined together working as one unit;

a filler element including but not limited a foam tape around said bracket placed on water tank lid or water tank to keep said water tank lid in level;

a flexible hose connected to said hand held sprayer with means to secure for the extended water supply from the source;

a filter insert for said flexible hose to remove the contaminated substances in the water;

a hose hanger for arrangement of said flexible hose having means to secure to fasteners around the toilet;

a filter connected to said flexible water hose with means to secure for eliminating the pollutants in the water;

a valve connected said filter with means to secure for regulating the water flow;

a mixing valve connected to said valve with means to secure to supply warm water by mixing hot and cold water delivered from two inlets;

a T-adapter connected to said mixing valve for tapping water from the existing plumbing fixture with means to secure;

a matching coupling connected to said T-adapter to correspond the various size or type of couplers as means to secure;

a water splash guard on underbody of toilet seat around the opening to protect water escape through the gap between the toilet seat and the toilet bowl.

2. Toilet system attached a hand held sprayer according to claim 1 wherein said bracket comprises:

a body having means to make said holder body be adjusted according to the inclined mounting area;

a reversed U-type clamp (namely "clamp") on said body having first element on said clamp for placement inside of the water tank, second element on said clamp for placement outside of the water tank, third element on said clamp connecting the end of first element and the end of second element for placement on the top edge of water tank, means including but not limited holes on said first element to be secured, an adhesive element for securing second element against the object to be placed on, a recessed area for said adhesive element on second element, a spacer connected to second element for formulating and sustaining body angle, means including but not limited hole on said spacer at the end to be secured, a cutout located between second element and said spacer for facilitating said spacer to be pivoted and adjusted;

an adjustable frame on said body having first element connected to said second element of said clamp, a space element below said third element of said clamp for placement of water tank lid, a cutout element located on said first element of said adjustable frame for facilitating said frame to be pivoted and adjusted, second element of said adjustable frame connected to the first element of said adjustable frame at one end, a prop element for reinforcement located along second element of said adjustable frame, a mound element on said prop element to provide reinforcement for means to secure, an anchoring base element having means to secure including but not limited lengthy loop hole for securing of said spacer of said clamp, an indentation element around said anchoring base element for affording friction to secure, means to secure including but not limited fasteners and locks to tie the said spacer of said clamp to said anchoring base element.

3. Toilet system attached a hand held sprayer according to claim 1 wherein said flexible hose comprises:

a body having structure of minimum three layers;

an inner hose element on said body as for one layer of said structure having features of small diameter to offer flexibility, maneuverability, and room for next outer layer for reinforcement without increment in thickness;

a reinforced element on said body including but not limited braided metal mesh as for another layer of said structure to reinforce said inner hose;

an ornamental external element on said body including but not limited flexible metal tube as for another layer of said structure to enclose the said braided metal element;

an inlet on said body for receiving the water;

a coupling on said inlet having means to secure including but not limited rotatable female threaded nut with seals;

an outlet on said body for delivering the water;

a coupling on said outlet having means to secure including but not limited rotatable female threaded nut with seals;

a channel in said inner hose element of said body connecting said inlet to said outlet for carrying water;

a functional element having the length being long enough to support for personal and environmental hygiene;

a functional element having the durability being strong enough to hold continuous high pressurized water for the use of the sprayer;

a functional element having the flexibility being comfortable to move for the use of the sprayer;

a functional element having the thickness being as small as possible to maneuver for the application;

an aesthetic element having the appearance being aesthetic for the display.

4. Toilet system attached a hand held sprayer according to claim 1 wherein said hose hanger comprises:

a body having but not limited flat bar for placement on to the fasteners around toilet;

an opening for permanent placement of a part of said flexible hose located but not limited under the said body;

a direction having but not limited lateral path of said opening for permanent placement;

a raised element at entrance of said opening for permanent placement to prevent easy displacement of said flexible hose;

a protruding line in said opening for permanent placement to lock in said flexible hose without slippage;

an opening for temporary placement of said flexible hose located but not limited next to said opening for permanent placement;

a direction having but not limited upward path of said opening for temporary placement;

a raised element at entrance of said opening for temporary placement to prevent easy displacement of said flexible hose;

a protruding line in said opening for temporary placement to lock in said flexible hose without slippage;

a prop element on said body for reinforcement;

a mound on said body for means to secure and reinforcement;

an opening on said mound for means to secure;

an indentation element on said mound for resistance of pivotal movement of said body;

an angle element of said body to be placed over the edge of toilet.

5. Toilet system attached a hand held sprayer according to claim 1 wherein said mixing valve comprises:

a body having an outlet for tempered water with means to secure including male thread, first inlet for receiving hot water having means to secure including male thread, second inlet for receiving cold water having means to secure including but not limited rotatable female threaded nut;

a channel in said body for connecting said first inlet and said second inlet to said outlet;

a valve in said channel to regulate the flow of said channel by opening the cold water at first and then opening the hot water to be added for safety;

a handle on said valve to facilitate turning;

a water supply line for said first inlet for receiving hot water having means to secure including rotatable female threaded nut on both end.

6. Toilet system attached a hand held sprayer according to claim 1 wherein said T-adapter comprises:

a body having an inlet with means to secure including but not limited rotatable female threaded nut to be connected to the outlet of the existing angle stop valve, first outlet with means to secure including male thread to be connected to the inlet of the existing water supply line, second outlet with mean to secure including male thread to be connected to the said mixing valve;

a channel inside of said body connected from said inlet to said first outlet and to said second outlet for the water flow.

7. Toilet system attached a hand held sprayer according to claim 1 wherein said matching coupling comprises:

a body having an inlet with means to secure including but not limited female thread to be connected to first outlet of said T-adapter and an outlet with means to secure including male thread to be connected to the inlet of the existing water supply line;

a channel inside of said body connected from said inlet to said outlet;

a body having an inlet with means to secure including but not limited female thread to be connected to the outlet of said existing angle stop valve and an outlet with means to secure including male thread to be connected to the inlet of said T-adapter;

a channel inside of said body connected from said inlet to said outlet.

8. Toilet system attached a hand held sprayer according to claim 1 wherein said water splash guard comprises:

a body attached on the underbody of toilet seat around the opening;

an edge on said body having round or beveled shape;

a width of said body preferably but not limited being large enough to cover the space between the toilet seat and the toilet bowl after placement of the seat on the bowl;

a length of said body preferably but not limited being long enough to enclose the opening of the toilet seat;

a base element on said body for means to secure;

a seal element including tape, sealer, or foam for said base element to be secured to said body of toilet seat;

an enclosed area having maximum proximity of toilet bowl opening for the most available space for use of said sprayer.

9. Toilet system attached a hand held sprayer according to claim 1 wherein said means to secure include various types of screw, thread, adhesive, hook, anchors, welding, or any fastening measures for joining one element to the other with or without using lock washers or seals including a rubber washer, an O-ring, or a gasket made of various materials.

10. Toilet system attached a hand held sprayer according to claim 1 wherein said toilet system includes a conventional toilet system for the purpose of conventional toilet usage having a seat with a large opening for communication with the toilet bowl.

* * * * *